United States Patent [19]

Brejcha et al.

[11] Patent Number: 4,586,716

[45] Date of Patent: May 6, 1986

[54] DOUBLE BULLSEYE FOR DART GAME

[75] Inventors: Robert J. Brejcha; Leonard J. Kubacki, both of St. Charles, Ill.

[73] Assignee: Industrial Design Electronic Associates, Inc., Sycamore, Ill.

[21] Appl. No.: 601,352

[22] Filed: Apr. 17, 1984

[51] Int. Cl.[4] ..... F41J 3/00

[52] U.S. Cl. ..... 273/376

[58] Field of Search ..... 273/374, 376

[56] References Cited

U.S. PATENT DOCUMENTS

| | | | |
|---|---|---|---|
| 1,253,700 | 1/1918 | McLaughlin | 273/81.2 |
| 1,306,048 | 6/1919 | Coy | 273/374 |
| 3,117,783 | 1/1964 | Reid | 273/376 X |
| 3,309,091 | 3/1967 | Haecker . | |
| 3,454,276 | 7/1969 | Brenkert et al. | 273/376 |
| 3,727,069 | 4/1973 | Crittenden, Jr. et al. . | |
| 3,807,858 | 4/1974 | Finch . | |
| 3,972,531 | 8/1976 | Knapp | 273/376 |
| 4,057,251 | 11/1977 | Jones et al. | 273/376 |
| 4,216,968 | 8/1980 | Yeeda | 273/376 |
| 4,222,564 | 8/1980 | Allen et al. | 273/369 |

FOREIGN PATENT DOCUMENTS

| | | |
|---|---|---|
| 520021 | 4/1930 | United Kingdom . |
| 2030877 | 4/1980 | United Kingdom . |

OTHER PUBLICATIONS

Project "ARACHNID", Report on the Pre-University Course Project, 1973.

English Mark Darts brochure.

*Primary Examiner*—Anton O. Oechsle

*Attorney, Agent, or Firm*—Hill, Van Santen, Steadman & Simpson

[57] ABSTRACT

A double bullseye for a dart game which can be electronically scored when hit by a dart wherein the outer bullseye comprises a concentric moveable segment and the inner bullseye comprises a cylindrical member received in a central guide opening of the outer segment and wherein the inner segment is formed with a shoulder which limits the outward motion of the inner bullseye. Both the inner and the outer bullseyes are formed with feet portions which are engageable with electronic pressure sensitive switches so as to record hits by a dart in the respective segments.

1 Claim, 7 Drawing Figures

FIG. 1
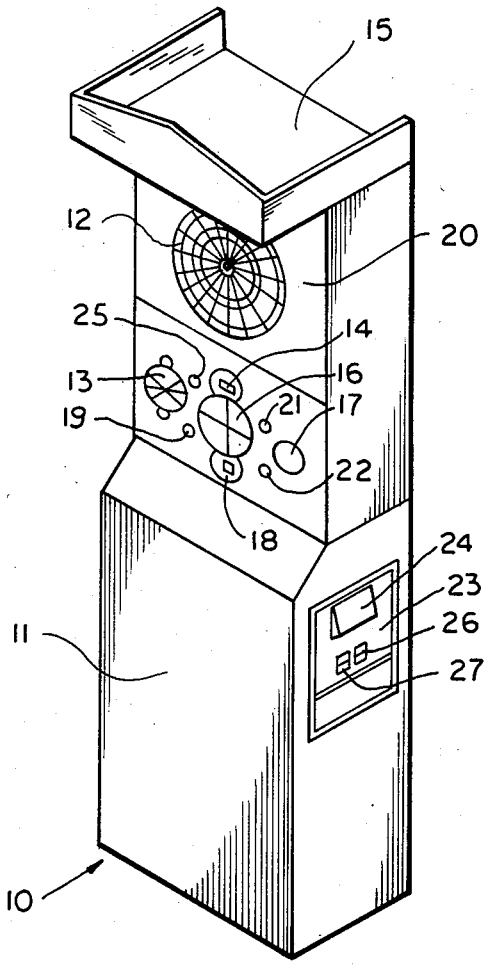
FIG. 3
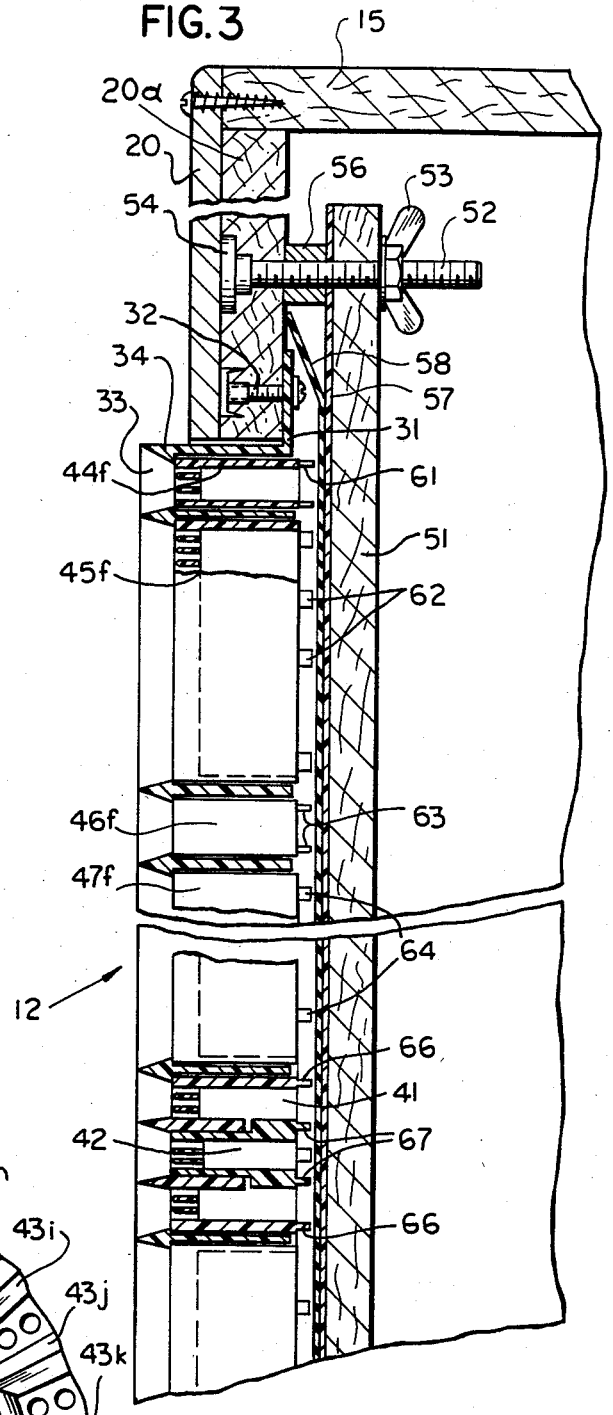
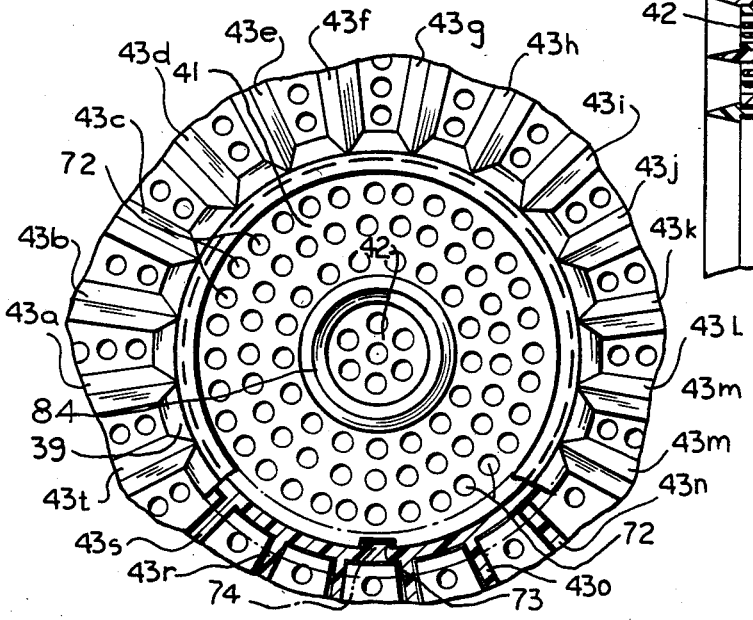
FIG. 5

FIG. 2
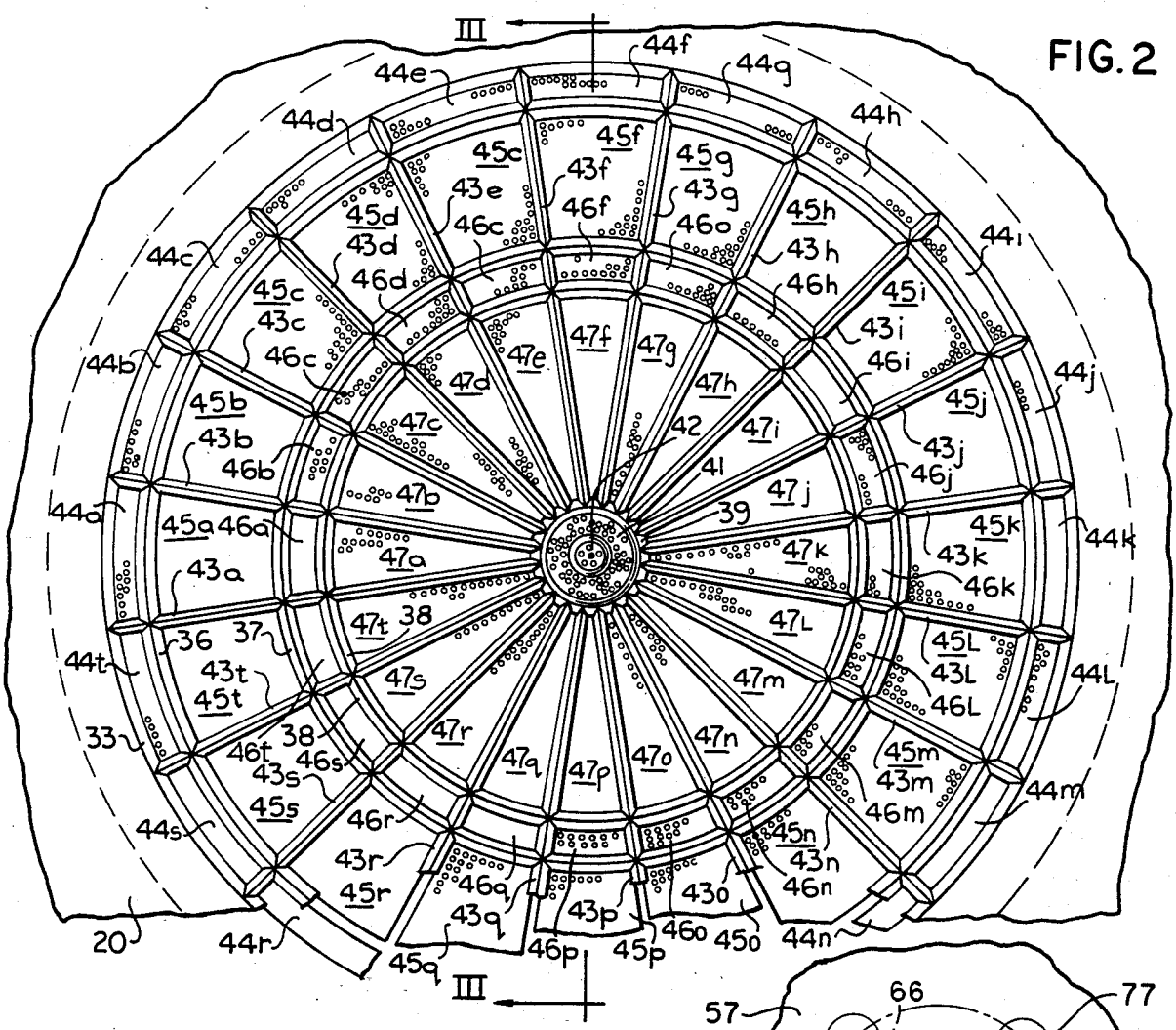
FIG. 6
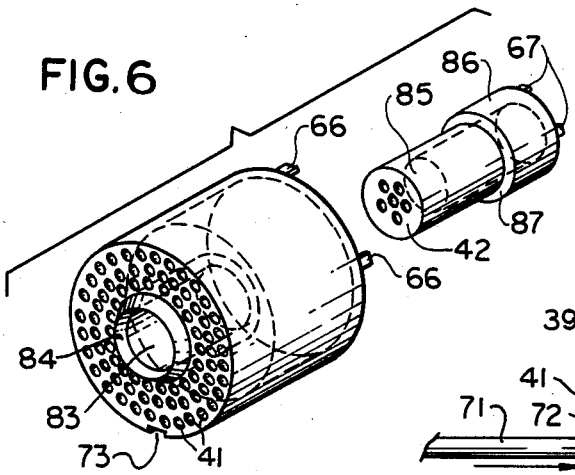
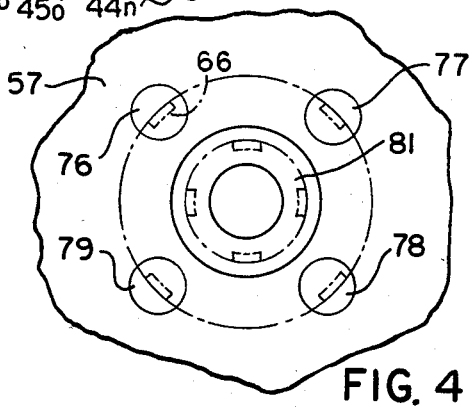
FIG. 4
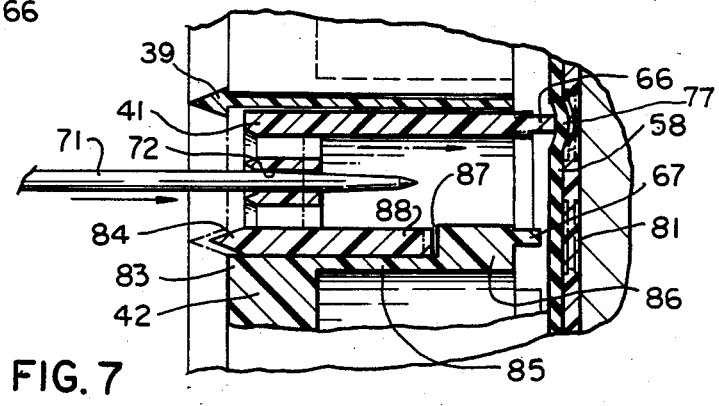
FIG. 7

DOUBLE BULLSEYE FOR DART GAME

CROSS-REFERENCES TO RELATED APPLICATIONS

This is an improvement on copending application Ser. No. 442,356 entitled "DART GAME", filed Nov. 17, 1982 assigned to the assignee of the present application.

BACKGROUND OF THE INVENTION

1. Field of the Invention

This invention relates in general to dart games and in particular to a computerized dart game which has a double bullseye so that the dart board of the game duplicates the official tournament dart boards which are used as the official bristol dart board of the British darts organization.

2. Description of the Prior Art

Electronic dart games are known such as illustrated in Pat. Nos. 4,057,251, 1,199,564, 2,808,266, 2,818,259, 3,309,091 and 3,454,276. In these patents, darts impinge upon a board so as to cause segments of the board to close a switch and wherein such switches are connected to components for registering, totalling and displaying the score of the player. However, it has not been possible with prior art electronic dart games to have a double bullseye as is utilized in the official dart game.

SUMMARY OF THE INVENTION

The present invention provides a double bullseye for an electronic dart game wherein the outer bullseye comprises a concentric segment which moves in a cylindrical holder and is keyed to the holder so that it cannot rotate and an inner bullseye of generally cylindrical shape which is guided by the outer bullseye and which has a shoulder which engages the outer bullseye to limit its outward motion. The inner bullseye is free to rotate relative to the outer bullseye and is formed with switch engaging feet so as to close a disc-shaped switch contact so as to record a dart hit in the inner bullseye.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 1 is a perspective view of the computerized dart game of the invention;

FIG. 2 is a front plan view of the dart board;

FIG. 3 is a detail enlarged section view of the invention;

FIG. 4 is a plan view illustrating the pressure sensitive switch;

FIG. 5 is an enlarged view of the bullseye member;

FIG. 6 is a perspective exploded view of the bullseye members; and

FIG. 7 is a sectional view of the invention.

DESCRIPTION OF THE PREFERRED EMBODIMENTS

FIG. 1 illustrates a dart game 10 of the invention which includes a base 11 and an upwardly extending portion 15 which carries a dart board 12. A control panel is mounted on the front portion 20 of the extending portion 15 and includes a game selector switch 13 which has a plurality of different segments which allow different games to be selected. The games can be selected such as 301, 501, high score, double in, double out, scram and Shang-hai. These are various games that vary the condition and scoring of the dart game and can be selected by the players as desired. A coin slot 24 is mounted on the side of the base 11 and a portion of 24 which also includes a coin rejector with a cancel switch at 24 and coin return switch also on 24 and coin return slots 26 and 27. The control panel also includes a removed dart indicator 25 and a bust indicator 19. A temporary score indicator 14 is mounted on the face plate as well as a round indicator 18. A score indicator 16 indicates the scores for the individual players up to four players. An indicator 21 indicates when darts are to be thrown and the game over indicator 22 is mounted below it. A push switch 17 is provided.

In prior art, electronic scoring dart games, it has not been possible to provide a double bullseye such as is utilized in the official dart game and the present invention provides a double bullseye so that the present game is identical to the official darts target.

In the present invention, regulation weight darts are thrown at the target which have plastic tip 71 as illustrated in FIG. 7 rather than steel tips which render the game safer since the plastic tips 71 are less likely to cause injury to a person if they accidentally hit him. FIG. 2 is a plan view of the target of the invention which comprises a plurality of equally spaced radial dart deflecting ribs 43*a* through 43*t* and a number of concentric ribs 33, 36, 37, 38 and 39 so as to divide the target into different scoring areas.

Double segments 44*a* through 44*t* are mounted between the rings 33 and 36. Larger scoring segments 45*a* through 45*t* are mounted between the rings 36 and 37, smaller triple score segments 46*a* through 46*t* are mounted between the rings 37 and 38. Pie-shaped segments 47*a* through 47*t* are mounted between the rings 38 and 39 and the double bullseye comprising an outer annular target portion 41 and an inner cylindrical portion 42 are mounted within the ring 39 and comprise the inventive concept of the present invention. In the prior art, only a single inner target segment provided the bullseye and, thus, the prior art electronic scoring dart games did not conform to the official dart board. The present invention provides both the outer bullseye 41 and the inner bullseye 42. It is to be realized, of course, that these two segments score differently in the official game and the official scoring is accomplished in the present invention.

FIG. 6 illustrates an exploded view of the inner and outer bullseye members 41 and 42. The outer annular bullseye 41 is cylindrical-shaped and is formed with a keyway 73 into which a key 74 of the ring 39 extends as shown in FIG. 5 so as to prevent the bullseye portion 41 from rotating relative to the ring 39 but allowing it to move in and out as it is struck by a dart to provide scoring. A ring 84 is provided to deflect darts into the scoring openings 72 of the members 41 or 42 as illustrated in FIG. 7 and the rear portion of the member 41 is provided with a number of feet 66 as, for example, four feet which are adapted to engage switch portions 76, 77, 78 and 79 when a dart 71 engages the member 41 as shown in FIG. 7. The switch segments 76, 77, 78 and 79 are formed on the pressure sensitive switch 57 illustrated in FIG. 4 and thus a circuit is closed whenever a dart engages an opening 72 due to the closing by feet 66 of any of the switch contacts 76, 77, 78 and 79.

The inner bullseye portion 42 is also illustrated in FIGS. 6 and 7 and has a smaller cylindrical portion 85 formed with openings therein for receiving the dart 71. A larger cylindrical portion 86 is formed on the rear portion of the member 42 and the shoulder 87 thus formed can engage an inner shoulder 88 formed on the outer bullseye member 41 as illustrated in FIG. 7. In FIG. 7, member 41 is moved to the right to close its switches, but member 42 is not moved by member 41 to close its switches. Suitable clearances are formed between the shoulder 87 and the shoulder 88 such that when a dart engages the member 41 to close the switches 76, 77, 78 and 79, the shoulder 87 does not engage the member 88 to cause feet 67 formed on the inner bullseye 42 to close an associated concentric switch 81 of the pressure switch 57. On the other hand, if a dart engages the inner bullseye member 42, the feet 67 will close the concentric switch 81 and, thus, an inner bullseye score will be recorded by the scoring mechanism of the electronic dart game.

FIG. 5 is a plan cutaway view of the inner bullseye illustrating the outer bullseye and the inner bullseye 42.

FIG. 3 is a cutaway sectional view of the score board illustrating the mounting means for the score board from the top portion 15 and the front portion of the case of the game. The dart board 12 is mounted to a wooden front plate 20*a*, by bolts 32 as illustrated. A plastic decorative panel 20 is mounted to the wood cabinet. The pressure sensitive switch 57 has a rubber backing 58 and is mounted to a support board 51 which is mounted by bolts and thumb screws 53 to plate 20*a* with standoff 56 providing the proper spacing and clearance. Rubber backing 58 provides a soft protective barrier between the feet on segments, e.g. 44, 45*f* etc. and the switch 57. Thus, by removing the thumb screw 53 from the bolt 52 the board 51 and the members 57 and 58 can be withdrawn from the housing of the game and broken dart points can be removed from the score board.

As shown in FIG. 3, the segments 44 have feet 61 for closing associated switch areas in the switch 57 and the segments 45 have associated feet 62 for closing associated switch segments in the switch 57. The segments 46 have feet 63 for closing associated switch segments and the segments 47 have feet 64 for closing associated switch segments.

It is seen that the present invention provides an inner bullseye 42 so as to allow different scoring in the inner bullseye portion 42 and the outer bullseye portion 41 which is identical to the official darts game and, thus, the electronic dart game of the present invention can be used for official dart contests.

It is to be realized, of course, as described in the above reference copending application, that the various contacts of switch 57 are connected to electronic scoring mechanism which actuates and indicates the individual scores in the scoring indicator 16 for the individual players. In a particular embodiment, two separate micro-computers were utilized, one to scan the switch segments 57 and the other to control the various indicators and totallizers of the invention. One of these micro-computers was an Intel type 8748 and the second micro-computer was an Intel type 8031. For the detail circuitry and operation of the micro-computers and the scoring reference may be made to the above referenced copending application. Such structure is well known to those skilled in the art and the inventive concept of the present invention is to the inner and outer bullseye structures 41 and 42.

Although the invention has been described with respect to preferred embodiments, it is not to be so limited as changes and modifications may be made therein which are within the full intended scope as defined by the appended claims.

We claim as our invention:

1. A target for an electronic dart game wherein said target is formed of a plurality of radially extending ribs and concentric circular ribs to divide the target into a plurality of scoring segments, a double bullseye scoring means mounted within the inner concentric circular rib and comprising an outer annular target portion moveably mounted in said inner concentric circular rib, an inner generally cylindrical target portion mounted withn said outer annular portion and moveably mounted relative to said inner concentric circular rib, and switch means with a plurality of switch areas mounted to said target and actuated by said outer annular target portion and said inner cylindrical target portion when they are engaged by a dart so as to separately score hits by darts, wherein said outer annular target portion is non-rotatably mounted relative to said inner concentric circular rib, wherein said outer annular target portion is formed with a longitudinal key way and said inner concentric circular rib is formed with an extension which is receivable within said key way to prevent rotation of said outer circular target portion, wherein said outer annular target portion is formed with at least one extending foot which is engageable with a switch area of said switch means when said outer annular target portion is engaged by a dart to score an outer bullseye score, wherein said inner cylindrical target portion has at least one extending foot which is engageable with a switch area of said switch means when said inner cylindrical target portion is engaged by a dart to score an inner bullseye score, wherein said inner cylindrical target portion is formed with a first target portion which extends through the central opening of said outer annular target portion and a shoulder target portion which is larger in diameter than said first target portion which cannot pass through the central opening of said outer annular target portion, and wherein said outer annular target portion can move longitudinally relative to said inner cylindrical target portion to score an outer bullseye score without causing said inner cylindrical target portion to score an inner bullseye score.

* * * * *